United States Patent [19]

Glover

[11] 4,242,092

[45] Dec. 30, 1980

[54] METHOD OF SUBLIMATIC PRINTING ON SHEET STRUCTURES

[76] Inventor: Richard D. Glover, Gedham Mills, Ossett, Yorkshire, England

[21] Appl. No.: 971,441

[22] Filed: Dec. 20, 1978

Related U.S. Application Data

[63] Continuation of Ser. No. 708,979, Jul. 27, 1976, abandoned, which is a continuation-in-part of Ser. No. 633,338, Nov. 19, 1975, abandoned, which is a continuation of Ser. No. 422,046, Dec. 5, 1973, abandoned, which is a continuation of Ser. No. 197,057, Nov. 9, 1971, abandoned.

[30] Foreign Application Priority Data

Nov. 12, 1970 [GB] United Kingdom ..... 53851/70
Dec. 24, 1970 [GB] United Kingdom ..... 61314/70

[51] Int. Cl.[3] ..... D06P 1/16; D06P 3/54; D06P 5/20

[52] U.S. Cl. ..... 8/472; 427/148

[58] Field of Search ..... 8/2.5 A, 177; 427/148

[56] References Cited

U.S. PATENT DOCUMENTS

| | | | |
|---|---|---|---|
| 3,464,779 | 9/1969 | Collez | 8/14 |
| 3,632,291 | 1/1972 | Defago et al. | 8/2.5 |
| 3,649,332 | 3/1972 | Dybvig | 427/391 |
| 3,768,280 | 10/1973 | Kannegisser | 68/5 D |
| 3,880,579 | 4/1975 | Renaut | 8/2.5 |
| 4,003,698 | 1/1977 | Snyder | 8/2.5 |
| 4,119,397 | 10/1978 | Snyder | 8/2.5 A |
| 4,128,395 | 12/1978 | Hadfield et al. | 8/2.5 A |

OTHER PUBLICATIONS

Ciba Review, Basel, 1971.

Jones et al., Jour. Soc. of Dyers & Colorists, vol. 82, No. 9, pp. 333–338, 1966.

*Primary Examiner*—Joseph L. Schofer
*Assistant Examiner*—Maria S. Tungol
*Attorney, Agent, or Firm*—Fred Philpitt

[57] ABSTRACT

The color printing of textile webs or structures such as carpets and tiles which are tufted or non-woven wherein the color is sublimatic dyestuff carried by an air permeable printing foil and this is placed over the textile structure with the dyestuff facing the textile structure. Heat is applied to vaporize the dyestuff and a pressure differential across the textile structure causes an air flow through the sheet structure and printing foil to affect penetration of the dye vapor into the structure. The dyestuff deposits on the textile fibres and filaments in the pattern it appeared on the printing foil. The said pressure differential is preferably produced by creating a vacuum at the side of the sheet structure opposite the printing foil.

10 Claims, 6 Drawing Figures

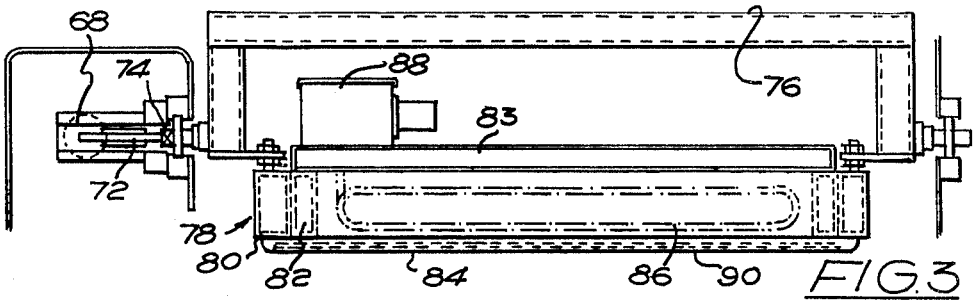
FIG. 3
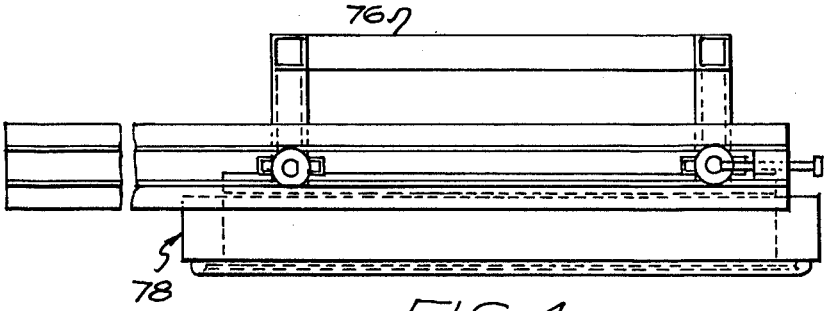
FIG. 4
FIG. 5
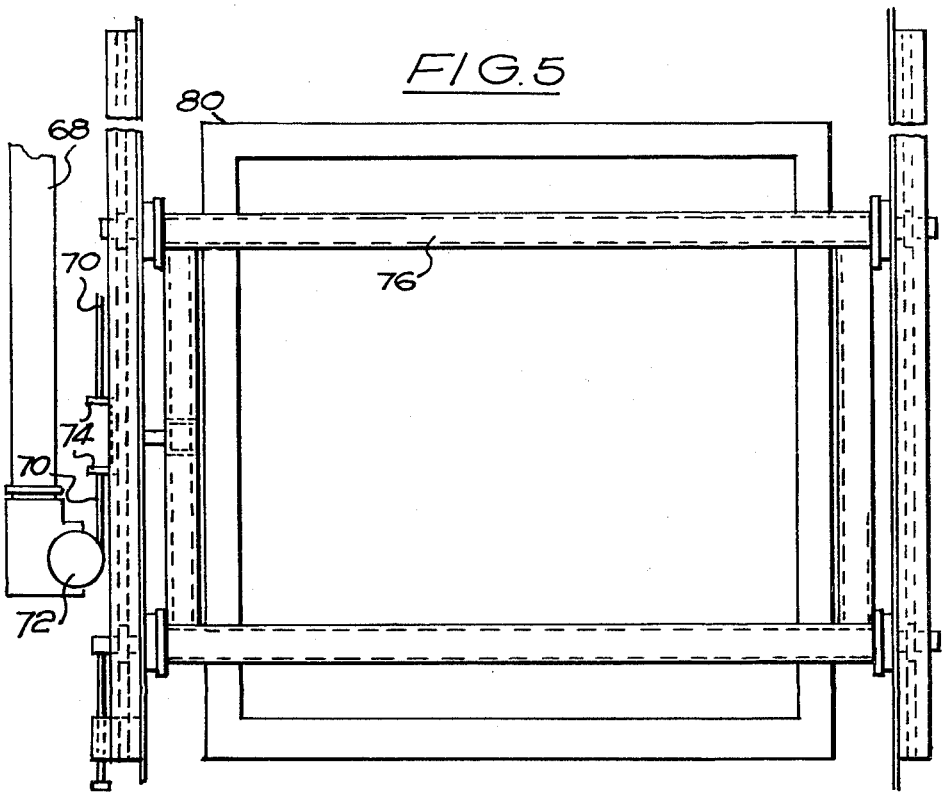

METHOD OF SUBLIMATIC PRINTING ON SHEET STRUCTURES

RELATED APPLICATION

This application is a continuation of application Ser. No. 708,979 filed on July 27, 1976 and since the present application was filed during the pendency of Ser. No. 708,979 the benefits afforded by 35 USC 120 are claimed with respect to it and to the series of application of which it is a continuation in part, which includes Ser. No. 633,338 filed Nov. 19, 1975, which is a continuation of Ser. No. 422,046 filed Dec. 15, 1975 which is a continuation of Ser. No. 197,057 filed Nov. 9, 1971 all now abandoned.

This invention relates to the colour printing, using sublimatic dyes, of air permeable sheet structures composed of or including material on and to which the sublimatic dye in the vapour phase will precipitate and adhere. Such sheet structures may include air permeable sheets composed of or including thermoplastic material such as plastics or resins not of a non fibrous or filamentary nature, but more commonly will be of or include fibres or filaments which are of a thermoplastic material such as plastics or resin, or which are coated with such thermoplastic material. Sheet structures of the latter category include knitted webs or sheets, woven and non-woven webs or sheets and tufted webs or sheets i.e. carpets, floor coverings, rugs and carpet tiles. The actual material of or coating on, the fibres and filaments will depend upon the sublimatic dyestuff which is used, but for commonly known dyestuffs, synthetic fibres and filaments of DICEL, TRICEL and NYLON (Registered Trade Marks) may be used and in general the fibres and filaments, or coatings, may be selected from the range polyamides, polyesters and acrylics.

It will be appreciated, however, as the explanation of the invention proceeds, that the actual dyestuff and sheet structure which are used are not of the essence of the principle of the invention, provided that the dyestuff is of the sublimatic type. i.e. it vaporizes upon the application of heat. The sheet structure is air permeable, and comprises or includes a material upon and to which the dyestuff in vapour state precipitates and adheres.

Thus at present, there does not appear to be a disperse sublimatic dye which has an affinity with natural fibres such as wool, cotton etc. but it is believed that present development will result in one or more disperse sublimatic dyes being produced which will be capable of being used for dyeing natural fibres. The present invention may be adapted readily for use with textile sheet structures largely of natural fibres upon the advent of suitable sublimatic dyestuff In printing using a sublimatic dye, the dye is printed on a carrier sheet, usually of paper, to produce what has become known as a printing foil and the paper is heated causi the dye to "sublime" in that the dyestuff in the dye vaporize and if the sheet structure of the nature set forth above is located adjacent the carrier sheet side carrying the dye, the colour precipitates on the sheet structure in the same pattern as the dye appears on the carrier sheet. Several colours can therefore be printed simultaneously although the process has been used for blanket colouring of a sheet structure.

One advantage of the sublimatic process is that only the dyestuff is vaporized and the other constituents of the dye are left on the carrier sheet; consequently the sheet structure may not require any further processing, such as steam cleaning to remove undesired residue, after the printing process.

One disadvantage of sublimatic printing is that penetration of the dye vapour into the thickness of the sheet structure is poor, particularly with relatively thick sheet structures such as carpets or densely compacted sheet structures such as needled flets, and indeed in tests on needled felts, whilst the definition of the printed pattern has been extremely good, the dye penetration has not been sufficient to make for a commercially acceptable article because with wear, the printing is quickly removed. Because of this disadvantage sublimatic colour printing has not found commercial application beyond the printing on thin woven or knitted sheets such as are used for manufacturing garments of outer wear such as skirts, ties, dresses and the like.

The present invention aims at overcoming the above disadvantage of sublimatic printing and according to the method of the invention an air permeable printing foil is used and a gas or vapour pressure differential is applied or created between the sides of the sheet structure to cause an air flow through the foil and sheet structure to assist penetration of the dye into the sheet structure during the sublimatic printing.

The pressure differential is preferably created by forming a vacuum pressure at the side of the sheet structure opposite to the side where the printing foil is located so as to draw the dye vapour into the sheet structure during the printing.

By creating an air flow through the foil and sheet to assist the dye vapour to move into the sheet structure, dye penetration into the sheet structure will be much better than when no such pressure differential air flow exists. As an alternative or in addition to the vacuum, the pressure on the side of sheet structure whereat the printing foil is located may be increased and air may be circulated through the sheet structure and printing foil.

The heat to vaporize the dyestuff may be applied in any suitable manner. The temperature at which sublimation of the dyestuff takes place will vary depending upon the dyestuffs used, but I have found that a temperature range of 140° C. to 230° C. covers most of the known sublimatic dyestuffs. The periods during which the heat is applied and the pressure differential will also vary depending upon the thickness of the sheet structure and the required depth of penetration of the dye, but these periods should be more or less the same and concurrent in order to avoid undesired migration of the dye.

In printing textile sheet structures, some of the thermoplastics fibre or filamentary materials or coatings used in the process may have a melting point lower than that at which the dyestuff sublimes, and in such case it may be advisable to prevent the textile sheet structure and printing foil from being in direct contact during the application of heat.

This may be achieved by placing an open mesh sheet of textile or other material between the printing foil and textile structure.

The printing of the pattern on the carrier sheet to produce the printing foil may be carried out in any conventional manner such as by silk screen printing, and the carrier sheet may have a plurality of pin-holes therethrough to render it air permeable to permit the through flow of air when the pressure differential is applied.

In another arrangement, the carrier sheet may comprise porous paper so that air can pass therethrough when the pressure differential is set up during printing, to assist a flow through the sheet structure, during printing, of air and dye vapour. If the paper, because it is porous, is somewhat flimsy then it may be treated with a composition so as to render it stiffer and thereby enable easy conventional printing thereon. This coating could be of a nature so that it decomposes under the action of the heat required to vaporize the dye. Such a coating may be, for example, ethyl cellulose. This may be applied by any suitable means or method such as spraying, dipping, brushing or the like.

This invention provides a real and considerable advantage in relation to thick textile sheet structures such as carpets, rugs, or needled fabrics of the type which are used as floor coverings. Previously, it was not possible to print by sublimatic pronting sufficiently permanent coloured patterns on these sheet structures because of poor penetration of the dye-stuffs. Moreover, other printing techniques are not suitable for the printing of carpets or carpet tiles, because these other techniques require the carpet or tile, subsequent to printing, to be steamed and dried, and these subsequent processes cause change in shape, particularly shrinkage, of the carpet or tile which of course is totally unacceptable. With the present invention however, subsequent steaming and drying are not necessary.

The invention further provides a machine for use in the method as aforesaid, comprising support means for supporting the sheet structure and the air permeable sublimatic printing foil, heating means for heating the foil to release the sublimatic dyestuff vapour and means for creating or causing a gas or vapour pressure differential across the sheet structure to create an air flow through the foil and sheet structure to induce or cause the dyestuff to penetrate into the sheet structure.

The support means preferably includes a flat grid structure forming the top of a chamber which is connected to a source of vacuum whereby a low pressure can be created on the side of the sheet structure placed on the grid structure and induce flow of dyestuff vapour into the sheet structure.

The heating means may be a plurality of heating elements contained in a heating plate structure. The heating plate structure is preferably located above the grid structure an said grid structure and heating plate structure are movable together into air sealing engagement whilst a sheet structu and superimposed printing foil are supported on said grid structure.

The heating plate structure is preferably mounted for horizontal movement relative to the grid structure to expose same and permit the location on and removal from the grid structure, of sheet structures to be printed and printed and their associated printing foils.

An embodiment of the present invention will be described by way of example, with reference to the accompanying drawings, wherein.

Figure 1:
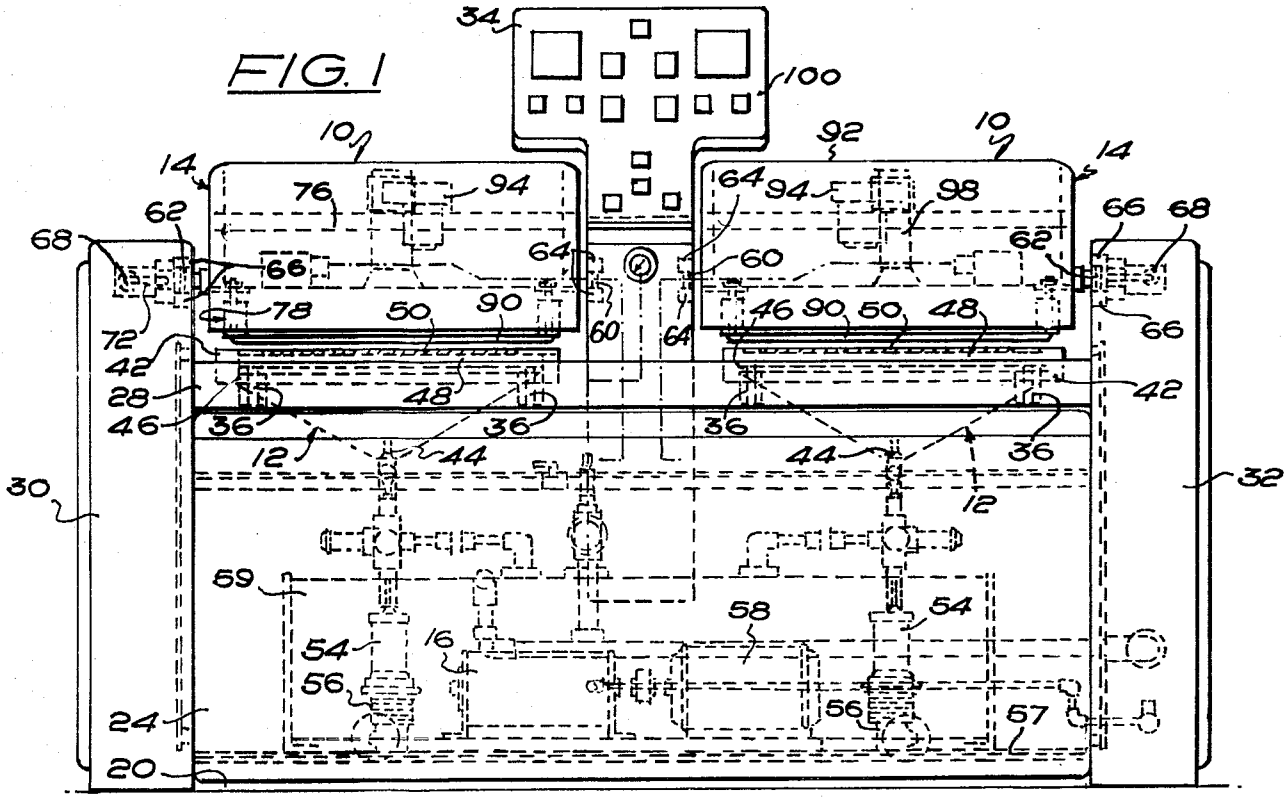
FIG. 1 is a front elevation of a machine according to and for carrying out the method according to the invention.
Figure 2:
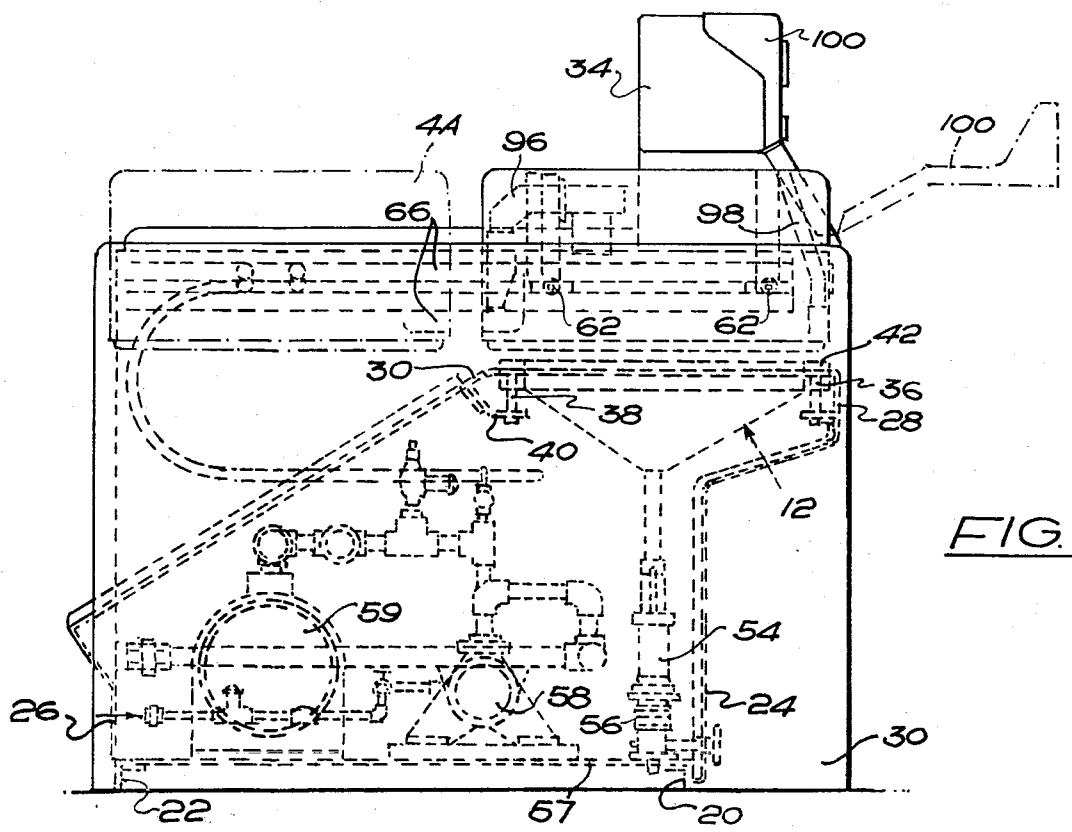
FIG. 2 is a side elevation of the machine shown in FIG. 1.
Figure 6:
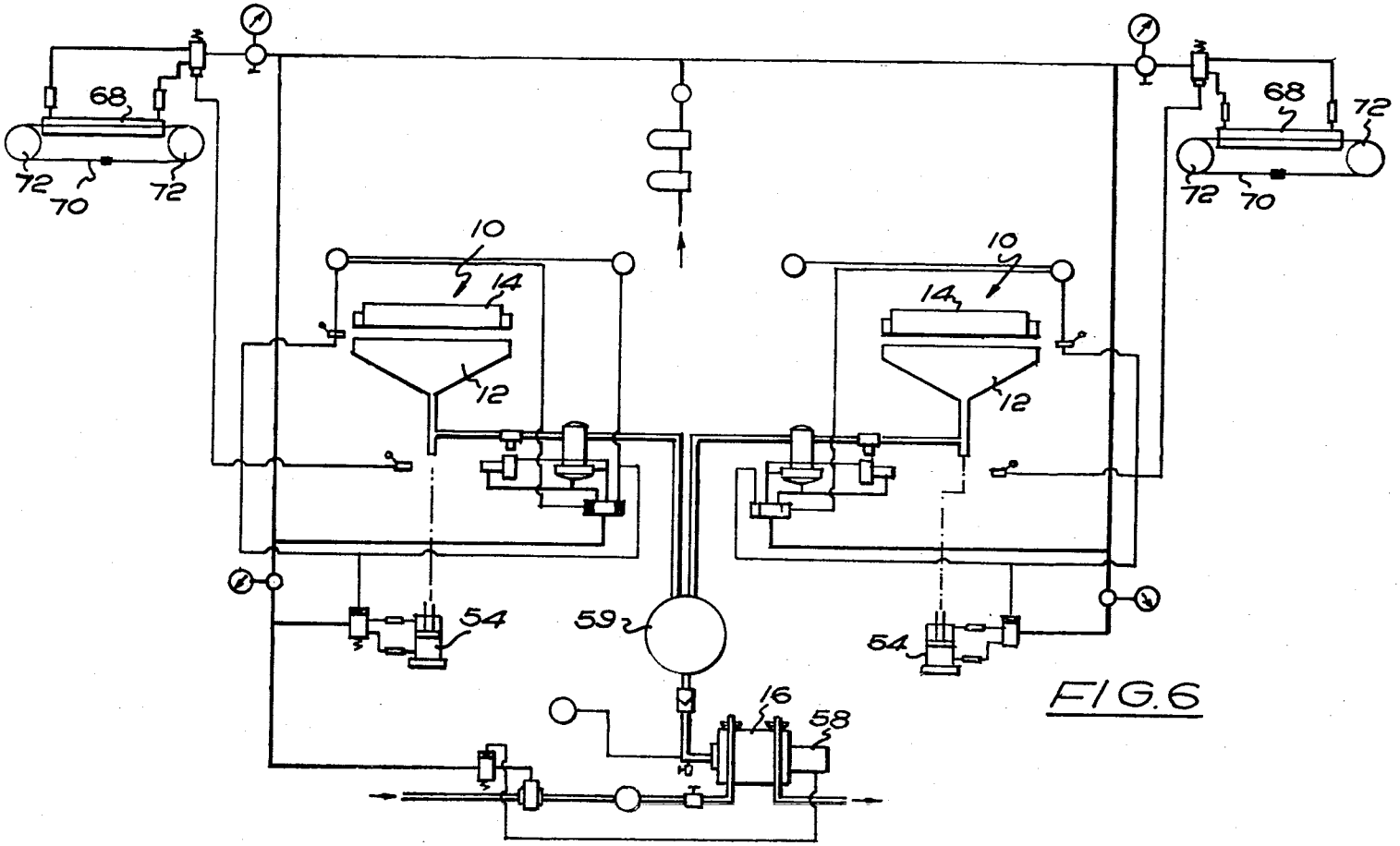

FIGS. 3, 4 and 5 are respectively a front elevation, a side elevation and a plan of one of the hood frames and its heating plate structure shown in FIGS. 1 and 2; and FIG. 6 is a circuit diagram of part of the pneumatic, vacuum and electrical systems of the machine shown in FIGS. 1 and 2.

The invention shown in the drawings is for the printing of square, air permeable, carpet tiles and is a "twin" machine in that it has two identical printing heads so that two tiles can be printed simultaneously. The machine can be operated however for the operation of the two printing heads alternately or the operation of one only of the printing heads whilst the other is being cleaned, serviced or repaired.

For the basic principle of operation of each printing head reference is best made in the first plate to FIG. 6. The two heads are illustrated by numerals 10 and each is seen to comprise a vacuum chamber or tank 12 the top of which is covered by a grid structure, and a heating plate structure 14. In the figure the top of tank 12 and the bottom of plate structure 14 are shown spaced slightly apart, but they can be moved into air sealing contact and are so moved together for the printing operation.

For the printing process, the tile to be printed is placed in register with the grid structure with the side to be printed facing upwards, the heating plate structure 14 having been moved horizontally, as it is able to do, relative to the tank 12 to permit the tile registration to be done easily. The air permeable sublimatic printing foil is placed in superposed relation to the tile with the dyestuff printing facing the tile and then the heating plate structure is moved back to the shown position.

Next, the heating plate structure 14 and tank 12 are moved together into air sealing contact, the heating plate structure operated to heat the printing foil and thereby release the dyestuff vapour and the tank 12 is vacated by a vacuum pump 16 to create a sub-atmospheric pressure in the tank thereby to set up a pressure differential between the sides of the tile so that an air flow through the foil end tile is set up and air and airborne dyestuff vapour are drawn down into the tile.

The dyestuff vapour penetrates at least partially the thickness of the tile and certainly much better than it would if there were no air flow caused by the vacuum created in tank 12. The vacuum and heating are applied for a pre-determined time depending upon the tile material and the dyestuff being used. At the end of this time the heating plate structure 14 and tank 12 are moved apart, the heating plate structure moved horizontally clear of the tank, the printed tile and its printing foil removed, and the printing head is ready for the next similar cycle of operations.

Structural details of the machine are now described with reference to FIGS. 1 to 5. Referring to FIGS. 1 and 2, the machine has a frame made up of a spaced lower front and rear angle bars 20,22 a front plate 24, a rear plate 26, and upper front and rear channel bars 28,30. The sides of the frame are closed by side housings, 30, 32 and located centrally of the front of the machine in an instrument console 34.

The printing heads 10 are located to each side of console 34 and the vacuum tanks 12 are located between the front and rear channel bars 28, 30.

Each vacuum tank 12 is slidably mounted for up and down movement on four guide pins 36, 38 of which the pins 36 are secured to a lower flange of channel bar 28 whilst pins 38 are carried by brackets 40 secured to channel bar 30.

Each tank 12 comprises a square, hollow box section frame 42 having holes in which pins 36, 38 locate and downwardly depending sheet metal walls which define the tank body and lead to a lower outlet 44 through which the tank is vacated.

On the inner wall of frame 42 is a ledge 46 on which the grid structure 48 sits. This grid structure comprises a plurality of grid bars 48 which are held one relative to the other in spaced parallel relationship and an expanded wire mesh screen which merely sits on top of the bars. The grid structure corresponds in dimension to the inner dimensions of frame 42 but is located under the top surface of the frame by an amount corresponding to the combined thickness of the sheet structure 50 (FIG. 1) to be printed, and its foil. Thus, the sheet structure 50 and its foil are located within frame 42 so that the foil lies flush with the top surface of the frame 42.

When it is desired to print sheet structures whose dimensions are smaller than the inner dimensions of the frame 42, a blanking plate having an aperture therein corresponding in size to the sheet structure is used, and the sheet structure being located in the said aperture, and the blanking plate covering that area of the grid structure not covered by the sheet structure, to ensure the effective application of the vacuum to the sheet structure.

The vacuum tanks 12 are adapted to be moved up and down individually in that each is connected to a short stroke pneumatic cylinder 54. The cylinders 54 are supported on screw jacks 56 and these in turn are carried by a base plate 57 extending between lower bars 20, 22. Adjustment of the screw jacks effects adjustment of the height of cylinders 54 and tanks 12, whereby the range over which the tanks 12 can be moved by cylinders 54 is adjusted.

The base plate also supports the vacuum pump 16 which is water cooled, an electric motor 58 connected to drive pump 16, and a vacuum reservoir 59 from which pump 16 exhausts air and which is in communication with outlets 44 of tanks 12.

Each of the heating plate structures 14 is mounted so as to be capable of being moved horizontally from front to rear of the machine between a forward position in which the heating plate structure is in superposed relationship with the associated vacuum tank 12 and a rearwards position, indicated in chain-dotted lines at 14A in FIG. 2, in which the heating plate structure is displaced horizontally of the associated tank 12.

To achieve this mobility of the heating plate structures, each structure has guide rollers 60, 62 on each side thereof and these rollers run respectively in guide rails 64, 66 which are located in the control console 34 and the associated end housing 32.

The means for moving each heating plate structure 14 comprises a double acting piston and cylinder device 68 contained in the associated end housing 32. The cylinder is stationary and the piston, which is movable in the cylinder, has its sides respectively connected to lengths of flexible member 70 (FIG. 5) which respectively are trained round pulleys 72 towards the front and rear of the end housing 32. The other ends of the members 70 are anchored to the heating plate structure as at 74 so that, in effect, the members 70 define an endless member trained between two pulleys 72 with the driving piston connected to one reach and the heating plate structure connected to the other reach. Movement of the piston therefore effects a similar, but opposite direction movement of the heating plate assembly.

Each heating plate assembly 14 (FIGS. 3, 4 and 5) is an inverted cradle frame 76 from which is hung a heating plate 78. The heating plate 78 is made up of a square hollow box section frame 80 on the inner wall and on the top of which are heat insulation layers 82, 83 and on the bottom of which is a metal heating platen 84. Contained within the plate 78 are electric heating elements 86 which receive power and are controlled from electrical control box 88.

On the underface of frame 80 there is a continuous sealing strip 90 of flexible material which is adapted to contact in an air sealing manner the top face of frame 42 of the associated vacuum tank when the heating plate structure is in the forward position and the tank 12 is moved upwards by cylinder 54. The sealing strip 90 is of such a thickness and compressibility in relation to the platen 84 that with the strip 90 sealing against the top surface of frame 42 of the associated vacuum tank, the platen 84 is spaced slightly from the printing foil and the tile to be printed for the effective application of heat to the foil.

Each heating plate assembly is provided with a hood 92 and an air cooling system comprising a fan 94 which draws air from the atmosphere and blows it into an inlet duct 96. This duct 96 opens into the interior of frame 80 and through aperture in the frame inner wall and the insulation 82 this air is blown into the compartment containing the heating elements 86. The air is exhausted by passing again through the apertures in insulation 82 and the inner wall of frame 80, and out of exhaust duct 98. Control console 34 has a panel 100 carrying the various instruments and dials for indicating the condition and operation of the machine.

FIG. 6 as stated previously, shows part of the pneumatic, vacuum and electrical systems of the machine and it will be understood these systems will be interlinked to give the desired sequence of operations, and automatic safeguards and warnings. The sequence of operations, it will be appreciated is largely a matter of convenience and is capable of being achieved readily by persons skilled in the field of sequencing systems.

The machine described, because of the novelty of the invention, is a prototype machine, and it is appreciated that the form of the machine may be changed as experience is gained in carrying out the printing of tiles. Moreover, machines of considerably different construction will be required for printing on different sheet structures such as continuous webs, where a rotary printing principle, for continuous production may be used.

In a modification of the machine described, the heating plate structure may be adapted to have its interior supplied with air under pressure and the structure would be arranged so that the pressure in this air would be applied to the air permeable printing foil to maintain some in contact with the sheet structure and also to create the flow of air through the sheet structure being printed to assist dye penetration.

The building up of pressure in the heating plate structure hood may be in addition or as an alternative to the creation of a vacuum in the tanks 12.

The machine will be provided with adjusting arrangements whereby the temperature to which the plate structures 14 are heated may be adjusted, the length of time the heat is applied may be adjusted, the vacuum in tanks 12 may be adjusted, the length of time the vacuum is applied may be adjusted, and the pressure applied to the printing foil and tile may be adjusted.

In some cases, better results are obtained if the tile is pre-heated before the printing process and for such cases the machine may be provided with a tile pre-heating unit. Alternatively, the heating plate structures could be used for the pre-heating of the tiles.

I claim:

1. A method of printing an air-permeable sheet structure which includes placing an air-permeable printing foil carrying on one side thereof sublimatic dyestuff in face-to-face relationship and in close proximity with the air-permeable sheet structure with the side of the printing foil carrying the dyestuff facing the air-permeable sheet structure, heating the printing foil for a period depending upon the sheet structure thickness to vaporize the dyestuff and applying a gas or vapor pressure differential during said period between the sides of the sheet structure so as to creat a flow of air from a space above the foil, and through both the foil and the sheet structure, and so as to cause the dyestuff vapor to flow into the sheet structure, said sheet structure being composed of a material to which the dyestuff has an affinity so that the dyestuff deposits on the sheet structure in the same pattern in which it appeared on the foil.

2. The method according to claim 1 wherein a vacuum pressure is formed at the side of the sheet structure opposite the side where the printing foil is located for the creation of said air flow.

3. The method according to claim 2 wherein the sheet structure includes fibers or filaments of a material for which the dyestuff has affinity.

4. The method according to claim 3 wherein the sheet structure is selected from the group consisting of tufted carpet, tufted carpet tiles, non-woven web and non-woven tiles of the said fibers or filaments.

5. The method as according to claim 4 wherein the said fibers or filaments are selected from the group comprised of polyamide, polyester and acrylic fibers or filaments.

6. The method according to claim 2 wherein the sheet structure is pre-heated before the printing operation.

7. The method according to claim 2 wherein the heat to vaporize the dyestuff is applied by a heating plate structure located in close proximity to the side of the printing foil opposite the sheet structure.

8. The method according to claim 2 wherein the printing foil comprises a porous paper sheet carrying the dyestuff.

9. The method according to claim 8 wherein said porous paper is coated with a composition which stiffens the paper and which decomposes under the action of the heat which vaporizes the dyestuff.

10. The method according to claim 9 wherein the said composition is ethyl cellulose.

* * * * *